United States Patent [19]

Ovaska et al.

[11] Patent Number: 5,042,621

[45] Date of Patent: Aug. 27, 1991

[54] METHOD AND APPARATUS FOR THE MEASUREMENT AND TUNING OF AN ELEVATOR SYSTEM

[75] Inventors: Seppo Ovaska; Matti Kahkipuro, both of Hyvinkaa, Finland

[73] Assignee: Kone Elevator GmbH, Baar, Switzerland

[21] Appl. No.: 426,172

[22] Filed: Oct. 25, 1989

[30] Foreign Application Priority Data

Oct. 25, 1988 [FI] Finland ..... 884919

[51] Int. Cl.[5] ..... B66B 3/00

[52] U.S. Cl. ..... 187/133; 187/101

[58] Field of Search ..... 187/130, 133, 101

[56] References Cited

U.S. PATENT DOCUMENTS

| | | | |
|---|---|---|---|
| 4,330,838 | 5/1982 | Yoneda et al. | 187/133 |
| 4,512,442 | 4/1985 | Moore et al. | 187/133 |
| 4,697,243 | 9/1987 | Moore et al. | 364/513 |
| 4,771,865 | 9/1988 | Hinderling | 187/130 |

FOREIGN PATENT DOCUMENTS

| | | |
|---|---|---|
| 2136158 | 9/1984 | United Kingdom . |
| 2180960 | 4/1987 | United Kingdom . |

*Primary Examiner*—A. D. Pellinen
*Assistant Examiner*—W. E. Duncanson, Jr.

[57] ABSTRACT

Method and apparatus for the measurement and tuning of an elevator system including at least one elevator having an elevator car and its control and driving equipment. The method uses at least one computer connected to the system. The elevator system is measured and tuned using virtual measuring and tuning components operated by programs of the computer.

14 Claims, 3 Drawing Sheets

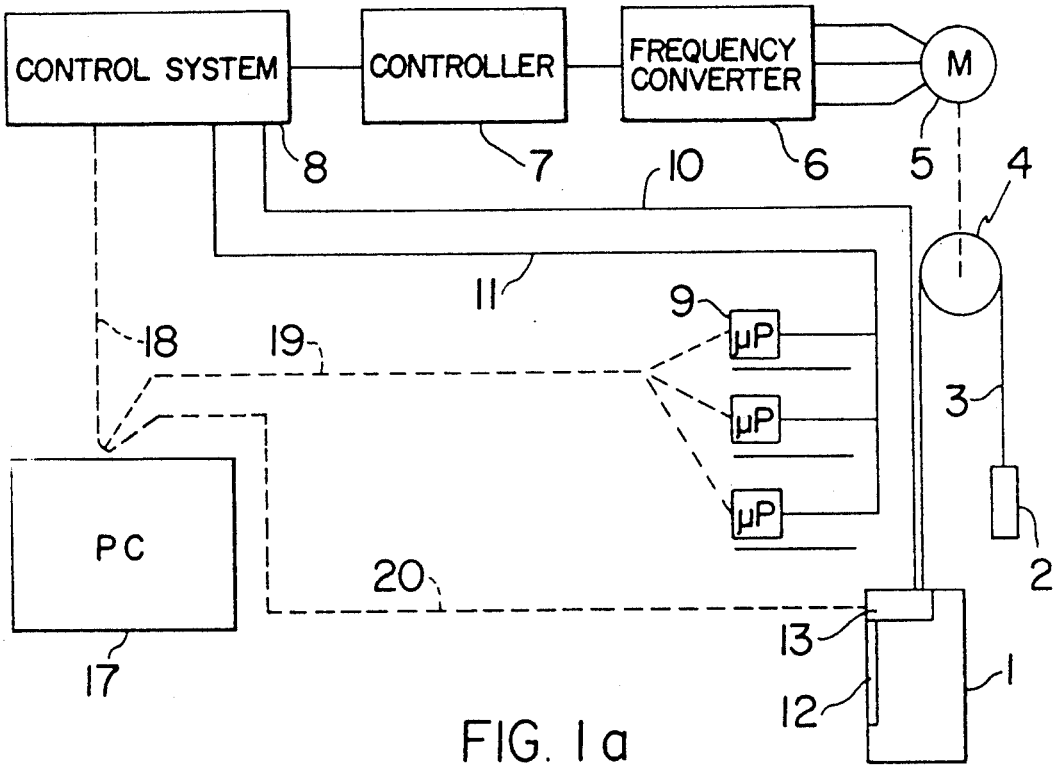
FIG. 1a
FIG. 1b
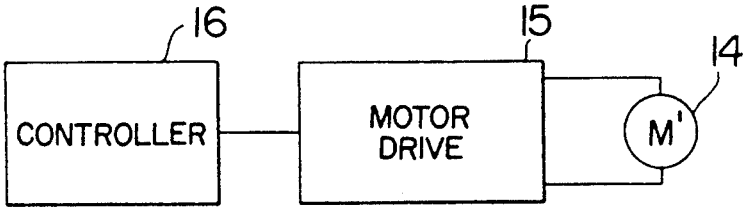
FIG. 2
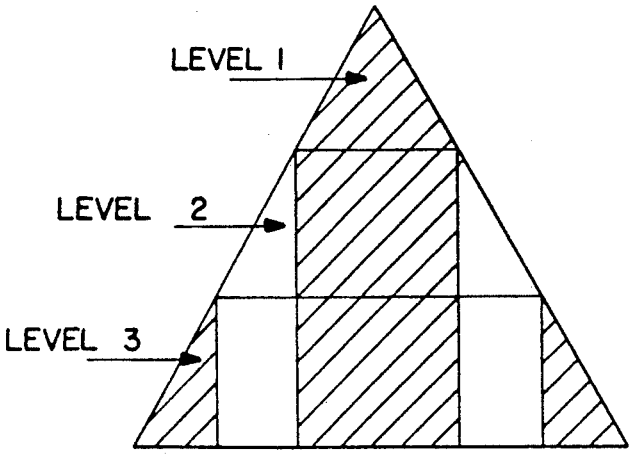

METHOD AND APPARATUS FOR THE MEASUREMENT AND TUNING OF AN ELEVATOR SYSTEM

TECHNICAL FIELD OF THE INVENTION

This invention relates generally to elevator systems, and more specifically to a method and apparatus for measuring and tuning of the elevator system by computer.

BACKGROUND ART

In the prior art, when an elevator was started, it has been necessary to use separate measuring equipment connected to the elevator components. Moreover, it has been necessary to use instruction manuals to provide the appropriate information regarding the starting-up operations of the elevator. For starting-up purposes, circuit cards in the elevator components are provided with various indicator lights (LEDs), switches, potentiometers and voltmeters/ammeters. The testing of elevator components, particularly assemblies which have several circuit cards, in a machine room environment has become very difficult, because the component and function density of integrated circuits has increased and continues increasing rapidly. The task of tuning, for example, setting the parameters for the speed servo of a fast elevator, requires an experienced installer and a number of discrete measuring devices, for example, an oscilloscope, a recorder and a spectrum analyzer.

For the starting up and final tuning of an elevator system, expensive measuring equipment, well-trained personnel and separate instruction manuals have to date been necessary. Locating a defective circuit card in machine room conditions is generally a difficult and time-consuming task. Using existing techniques, it is impossible to check the quality of the tuning except from the machine room of the elevator. The indicator lights, switches, potentiometers, etc., placed on the circuit cards increases the cost of the product.

SUMMARY OF THE INVENTION

An object of the present invention is to eliminate the problems described above.

Another object of the invention is to reduce the time required for installation and testing, during manufacture, the amount of paper required for documentation, the need for training and the cost of the necessary equipment, yet without rendering the equipment complicated or difficult to use.

A further object of the invention is to enable a single apparatus to be used for both the tuning and measurement of the whole elevator system and to improve the standard of the tuning and measurements.

The use of virtual components as provided by the invention allows the application of a safe and hierarchic tuning organization which takes the level of skill of the person performing the tuning into account and limits the range of operations allowed for the person in question. This makes it impossible for anyone to select insensible tuning parameter values out of lack of knowledge. The lower the level of skill a person in this hierarchy, the more limited are the range of tuning operations allowed to that person.

The phrase "virtual components", for the purposes of this application, defines components whose operation are at least partly an internal programmed operation of a computer. On a computer display the virtual components are represented by icons. The icons symbolize an operation that corresponds to the operation of a real, physical instrument or component.

The system of the invention allows for the remote monitoring and tuning over telephone lines, which means that a specialist will be able to carry out tuning without entering a machine room. The machine room may even be located in another country or continent.

Large elevator groups or elevators similar to each other can be started up faster becausing tuning parameters can be transferred from one elevator to another. After one of the elevators in a group has been started up the parameters of this elevator can be utilized in starting up the rest of the elevators in the group. No separate measuring instruments are needed for the starting up, because the system employs a computer which includes all the necessary virtual components, specially fitted for the particular needs in each case. It is easier to use virtual instruments than general purpose instruments. To be able to carry out a tuning operation, a person need not have a detailed knowledge of the system, because the computer provides step-by-step guidance.

BRIEF DESCRIPTION OF THE DRAWINGS

FIG. 1*a* is a pictorial representation of a tuning apparatus connected to a microcomputer-based elevator system.

FIG. 1*b* is a block diagram of a door drive.

FIG. 2 is a pictorial representation of a tuning hierarchy based on the level of skills of a user.

DESCRIPTION OF PREFERRED EMBODIMENTS

Figure 3:
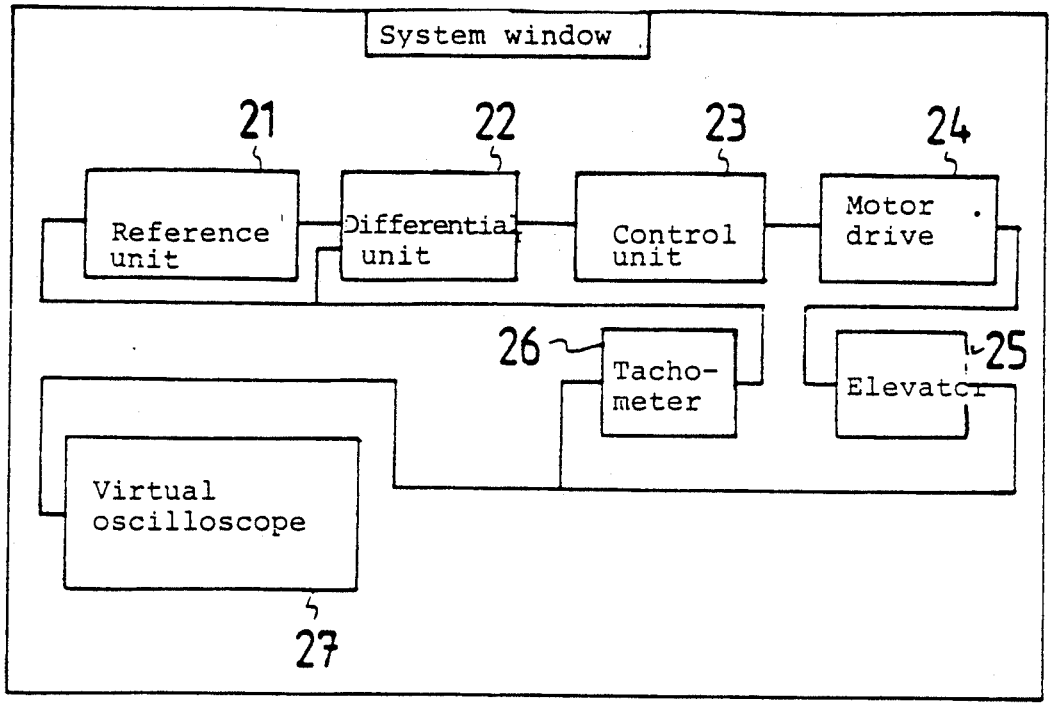
FIG. 3 is a block diagram example of a system.

The invention is based on the use of a virtual apparatus for the tuning of an elevator system as shown in FIG. 1(*a*). The elevator system comprises an elevator car 1, counterweight 2, suspension ropes 3, traction sheave 4, motor (M) 5, a frequency converter 6 driving motor 5 and control system 8, which is connected to a controller 7 and, by trailing cable 10, to elevator car 1, and, by follow cables 11, to floor-specific processors 9. A door of the elevator car is actuated by a door drive 13, which as shown in FIG. 1(*b*), includes motor (M') 14, a motor drive 15 and its controller 16. The tuning apparatus is composed of a separate portable computer (PC) 17, its programs, a hierarchic instruction manual for the elevator system and the connections 18, 19 and 20 to the elevator system. The instruction manual is stored in the mass memory of the computer, and the pages of the manual can be viewed on the display.

The virtual tuning apparatus replaces the discrete measuring instruments that are otherwise needed for tuning. It also contains a set of programs providing step-by-step guidance for the person performing the tuning. With the aid of these programs, the computer, the components of the elevator system and the components incorporated in the measuring equipment are controlled so as to form the required virtual measuring instruments and control components. The tuning operations are carried out, either locally in the elevator machine room or remotely via a telephone line. The tuning and measurements may be accomplished either from the elevator car, from one of the floor levels or over the telephone. The portable personnel computer (PC) 17 is provided with an asynchronic serial interface communicating via an RS232C port. For communication with the elevator system, an RS232 serial channel is used.

At the manufacturing stage, using the apparatus of the invention, the parameters for the microcomputer-based components, such as the door drive, the motor drive and the elevator supervision system, can be set in advance. During installation, parameters can be tuned and components can be tested. During normal operation, it is impossible, for example, to change the drive curve parameters, carry out run-time analysis of the required functions and supervise the elevator system.

All configuration of the system are effected by using block diagrams and a data base. The data concerning the elevator components are input using an interactive block diagram editor, which is, for example, in mouse/-keyboard controlled. For each component of the elevator, the necessary data are stored in memory. The block diagram editor is also used to input the tuning and measurement displays. To fetch a block diagram to the screen, the user selects the blocks from a menu of functional units, defines the parameters for the blocks and draws the required connecting lines between the blocks. When a new component is to be stored in memory, it is defined on the block diagram level together with the connections associated with it. For the component block diagrams there is a system window which may be either active (visible) or passive (invisible).

The block diagrams contain several hierarchy levels as shown in FIG. 2, which are dependent on the user's level of skill. They are stored in a data base which contains a brief functional description of each component and the necessary information on the parameters of the block. The screen displays, for tuning and measurement, can be configured by the user. For each user, only those tuning devices which belong to the user's hierarchy level of skill are displayed on the screen.

There may be, for example, three hierarchy levels, as represented in FIG. 2, Level 1 for basic tuning operations by untrained personnel, level 2 for specific fine tuning operations by users at a low level of training, and level 3 for all tuning operations by fully trained personnel.

Parameters are transferred from one elevator to another by transferring the parameter files, for example, by means of diskettes. The same diskette may contain several different tuning parameter units, one of which is active at a time.

During tuning and measurement, separate diagrams of virtual tuning instruments, virtual measuring instruments, system blocks as well as the measured and calculated data are displayed on the screen. The tuning and measurement operations are performed using a mouse or an equivalent and a display presenting information—mostly in pictorial form—on the operation in question.

Virtual tuning instruments are, for example, a potentiometer, a switch, a cross-connection matrix and a buzzer.

Virtual measuring instruments are a measuring point, an LED, a voltmeter, a dual-channel oscilloscope, a dual-channel FFT spectrum analyzer with a transfer function analysis capability, a signal recorder and a signal/noise generator.

The virtual measurements are based on the use of user-selectable measuring instruments, which can be hooked up to any of the connecting lines in the component block diagram. Each measuring instrument has its own predefined symbol in the block diagram as well as its own general schematic display diagram. This window, too, may be either active or passive. Moreover, each measuring instrument is associated with its own settings window, which is superimposed on any other windows except the display window. It can be displayed temporarily when the settings for the instrument are being adjusted. The sampling time for a measuring instrument is an integer multiple of the sampling time for the relevant elevator component.

FIG. 3 shows an example of a system block diagram (system window), in which the output of the tachometer 26 is connected to a virtual oscilloscope 27 A reference value produced by a reference unit 21 is input together with the actual value obtained from the tachometer 26 to a differential unit 22 to produce the difference between the actual and reference values. This difference is input to the control unit 23 controlling the motor drive 24.

Figure 4:
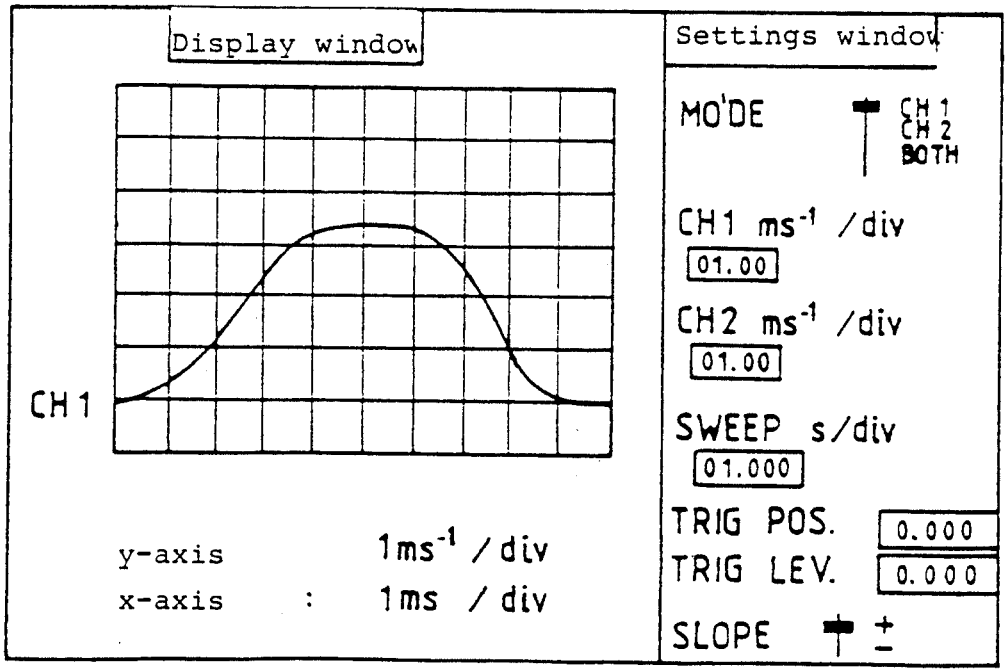
FIG. 4 is a pictorial representation of a display window and the settings window of the virtual oscilloscope of FIG. 3.

FIG. 4 shows the display and settings windows for the virtual oscilloscope 27 in FIG. 3. In the display window is shown a plotted elevator's speed curve versus time. The settings window reveals that channel 1 (CH1) of the oscillator has been selected, using a MODE selector, as the channel through which the speed curve is output. In addition, the window displays certain oscilloscope values for channels CH 1 and CH2.

The virtual tuning is based on user-definable tuning diagrams, which comprise at least one hierarchy level for each elevator component with tunable parameters. The diagrams contain the virtual tuning instruments and alternative virtual measuring instruments with which it is possible to adjust the user-definable elevator component parameters and monitor certain signals. There are two independent tuning windows, each of which can contain only one tuning diagram at a time, displayed either separately or together with the other window. For users at different levels of training, there are separate tuning levels differing in the degree of difficulty.

Figure 5:
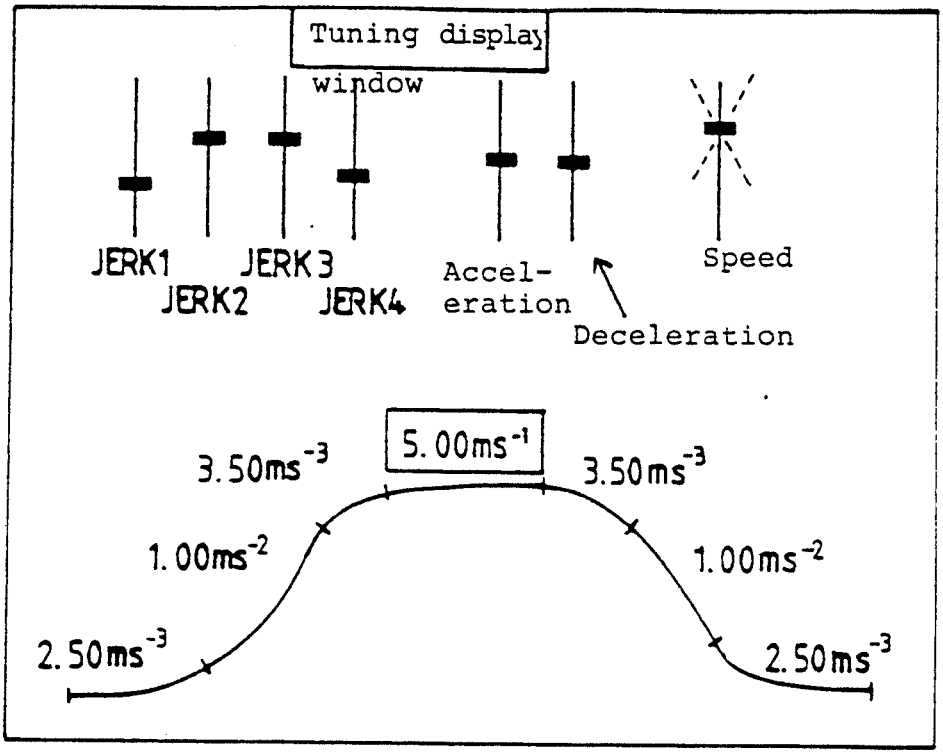
FIG. 5 is a pictorial representation of an example of a tuning display including virtual instruments.

FIG. 5 shows an example of a tuning display (window) consisting of virtual instruments. It comprises potentiometers JERK1–JERK4 used for adjusting the slope of the speed curve during acceleration and deceleration, and potentiometers regulating acceleration and deceleration, and potentiometers regulating acceleration, deceleration and speed. The selected function is indicated in the figure by broken lines, but on the screen it can be indicated e.g. by displaying the symbol more brightly illumined than the others. It is also displayed in a box in the lower part of the screen along with the speed curve.

The tuning and measurement diagrams are stored in a definitions data file, and the specifications of the devices to be tuned are stored in a tuning data file. The user interface takes care of external I/O functions, i.e. keyboard input, mouse input and graphics output. The supervision and data processing functions take care of menu management (control of hierarchy), window management (activation/passivation), transmission of tuning data to the user interface, and the display generator. The internal I/O control takes care of the by-passing of commands and the reception of information.

The function selection takes care of the activation of the required processes. If a process cannot be activated immediately, an error message is sent to the user interface process. The function selection is in charge of
receiving the selection
triggering the processes
wait until state change is allowed
activate process
passivate process
reporting on the process status
controlling the error message generator.

The virtual tuning process handles the virtual tuning instruments in accordance with the tuning operations selected. When a particular system is being generated, the tuning diagrams are defined and stored in a definitions file. The available tuning instruments are also defined at the generation stage, and their specifications are stored in the tuning data file. The tunable parameters are stored in an elevator parameter file. By virtual tuning, the tuning commands are received and checked for acceptability (upper and lower limits of the parameters being tuned), the values of elevator parameters are changed, and the following serve parameters are tuned automatically (off-line): identification of data query, identification of the system and optimization of the servo parameters.

Figure 6:
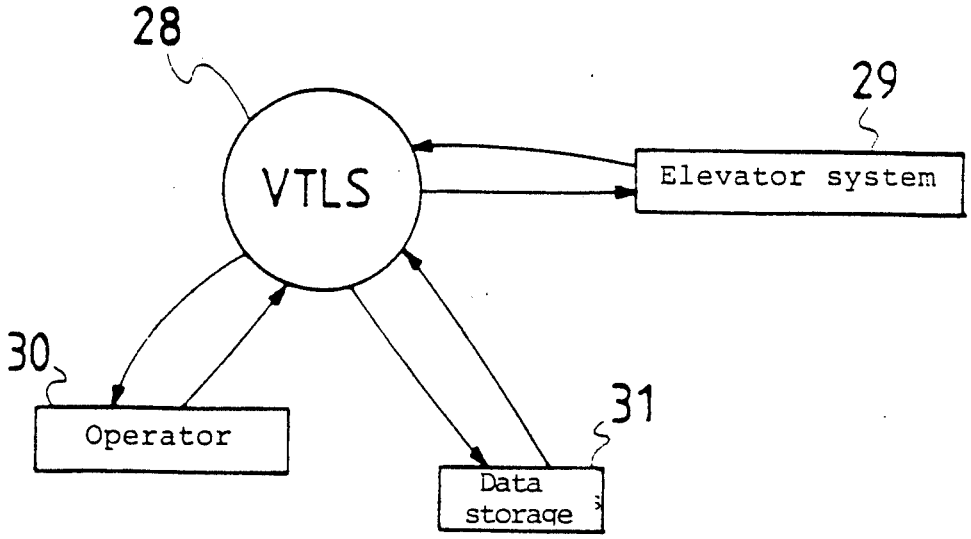
FIG. 6 is a diagram showing external connections of a computer.

In virtual measurement, the desired measurements are performed using intelligent virtual instruments. The measurements may be either direct (e.g. a sample of the tachometer signal) or performed by a digital servo as they may consist of processed measurements (e.g. of the tachometer signal) calculated by the measuring process itself. The functions of virtual measurement are
to receive queries concerning measured/generated data
to classify the queries received
to query data from a digital servo computer
to process the queried data:
to calculate the mean value of measured samples
to weigh the measured data (gain, offset)
to find the peak values
to shift the average filtering (reduce wide-band oscillation)
to filter the median (reduce impulsive noise)
window (rectangular, Hamming)
FFT (lengths e.g. 64, 128, 256, 512 and 1024)
to generate data for the servo computer
additional noise (irregularly distributed)
step function The system generation function is in charge of general initialization and configuration of the system. General initialization means
initialization of the hardware
definition of the process structure
initialization of data areas Configuration of the system comprises
generation of component block diagrams
generation of tuning diagrams
generation of measuring diagrams
saving of initial parameters of elevator components
storage of current parameters
selection of language
automatic shut-off in the event of misuse The parameter-processing function is in charge of the communication between the computer and the elevator system. It also takes care of the storage of parameters and data and handles the following special operations:
two-way communication
message passing
disk/diskette operations (save/retrieve)
encoding/decoding of messages
reception of queries from other processes
passing of parameters/data to other processes FIG. 6 illustrates the connections of the tuning computer (VTLS) 28 in the elevator system, the arrows representing the direction of communication. The operator 30 gives commands to the computer and sees the results on the screen. The elevator system 29 supplies the computer with the parameters and other data as required, and receives the changed parameters and the queries. The data storage 31 supplies the computer with initial parameters and receives from it the changed parameters and the measured data.

It is obvious to a person skilled in the art that different embodiments of the invention are not restricted to the examples described above, but that they may instead be varied within the scope of the following claims.

We claim:

1. A method for the measurement and tuning of an elevator system which includes at least one elevator including an elevator car and its control and driving equipment, the method comprising:
using at least one computer connected to the system; and
measuring and tuning the elevator system by using virtual measuring and virtual tuning components operated by means programs of the computer.

2. The method according to claim 1, wherein said components include components of the elevator system and are virtual components whose parameter data are stored in the memory of the computer.

3. Method according to claim 1, wherein virtual measurement is performed within a block diagram representing the components of the system by connecting virtual measuring components to connecting lines between the blocks.

4. Method according to claim 1, wherein the measuring components have their own block diagram symbols and a general display diagram, and each measuring component is associated with a settings display placed in a setting window.

5. Method according to claim 1, wherein virtual tuning is performed by using user-definable tuning diagrams including at least the virtual tuning instruments and at least one tuning window.

6. Method according to claim 1, wherein the virtual tuning process includes different tuning levels, within each of which only certain tuning operations are permitted.

7. Method according to claim 1, further including transferring from one elevator to another elevator parameter files or parts of parameter files, in which parameter data for the components are stored.

8. Apparatus for the measurement and tuning of an elevator system comprising:
a least one elevator including an elevator car and its control and driving equipment;
at least one computer operatively connected to the system;
virtual measuring and virtual tuning components operatively connected to said computer; and
means for controlling said virtual measuring and virtual components means by using programs of the computer, so that said virtual measurement and virtual turning components can be used to perform the measurement and tuning of the elevator system.

9. Apparatus according to claim 8, wherein the computer is a portable personal computer.

10. Apparatus according to claim 8, wherein said virtual tuning components includes a potentiometer, a switch, a cross-connection matrix and a buzzer.

11. Apparatus according to claim 8, in that said virtual measuring components include a measuring point, an LED, a voltmeter, an oscilloscope, a spectrum analyzer, a signal recorder and a signal/noise generator.

12. Apparatus according to claim 8 wherein there are means for the computer to communicate with the elevator system over a telephone line.

13. Apparatus according to claim 8, further including a hierarchic instruction file stored in the computer.

14. Apparatus according to claim 8 including diskettes for transfering parameter files or parts of parameter files, holding component parameter data, from one elevator to another, a diskette used for transferring containing one or several different tuning parameter units, one of which is active at a time.

* * * * *